US005374149A

United States Patent [19]

Lichti

[11] Patent Number: 5,374,149

[45] Date of Patent: Dec. 20, 1994

[54] VERTICAL STORAGE CONVEYOR WITH SYMMETRICAL MOTOR DRIVE SYSTEM

[75] Inventor: Robert D. Lichti, Lake Almanor, Calif.

[73] Assignee: CompuTower Technologies, Corp., Miami, Fla.

[21] Appl. No.: 4,081

[22] Filed: Jan. 13, 1993

[51] Int. Cl.[5] ..... E04H 6/00

[52] U.S. Cl. ..... 414/234; 414/248; 414/251; 198/800

[58] Field of Search ..... 414/233, 234, 248, 251; 198/797, 798, 800

[56] References Cited

U.S. PATENT DOCUMENTS

| | | | |
|---|---|---|---|
| 3,278,052 | 10/1966 | Lichti . | |
| 3,424,321 | 1/1969 | Lichti . | |
| 3,547,281 | 12/1970 | Lichti . | |
| 3,656,608 | 4/1972 | Lichti . | |
| 4,826,384 | 5/1989 | Okura | 414/234 |

FOREIGN PATENT DOCUMENTS

| | | | |
|---|---|---|---|
| 85074 | 7/1978 | Japan | 414/234 |
| 85076 | 7/1978 | Japan | 414/234 |
| 178679 | 7/1989 | Japan | 414/234 |
| 47474 | 2/1990 | Japan | 414/234 |

OTHER PUBLICATIONS

Marketing Brochure of prior model (22D) entitled "Park Mobile Exteriors", published more than one year before Jan. 13, 1993.

Marketing Brochure of prior model (22D) entitled "There's Only One Way To Go", published more than one year before Jan. 13, 1993.

SUN Microsystems, Network Programming: Chapter 5: "External Data Representation: Sun Technical Notes", Revision A, 27 Mar. 1990, pp. 103–128.

Winroth, Harold, "External Object Representation", Computational Vision and Active Perception Laboratory (CVAP), Stockhom, Sweden, 9 Jul. 1992, pp. 1–19.

Ford, Steve, "DARPA Open Object-Oriented Database Preliminary Module Specification", Object Translation, Verison 4, Nov. 20, 1991, Texas Instruments Incorporated, Dallas, Tex. 75265, pp. 1–81.

*Primary Examiner*—Richard A. Schacher

*Attorney, Agent, or Firm*—Morgan & Finnegan

[57] ABSTRACT

A vertical conveyor which is preferably for storing and conveying automobiles is disclosed. The conveyor is comprised of two, spaced apart parallel vertical frame members supportingly connected together with a plurality of diagonal braces and horizontal beams. An endless compression chain which is in the shape of a racetrack is mounted in each frame member, and each end of a plurality of platforms which hold the automobiles is connected to compression links of the corresponding compression chain. A motor drive unit is mounted between the frame members in the space between passing conveyed platforms. The motor drive unit comprises a single double ended electric motor having a housing and a driven shaft extending from both sides of the housing. The motor is centrally mounted between the frame members, and two substantially similar, but oppositely extending, drive trains are operatively connected at respective ends of the motor shaft. Each drive train includes a drive shaft, a first universal joint directly connected between one end of the drive shaft and a corresponding end of the motor shaft and a second universal joint directly connected between the other end of each drive shaft and a remotely operable brake mounted on the corresponding frame member. Each drive train also includes a reduction gear operably connected between the brake and a drive system which rotates the corresponding compression chain.

22 Claims, 6 Drawing Sheets

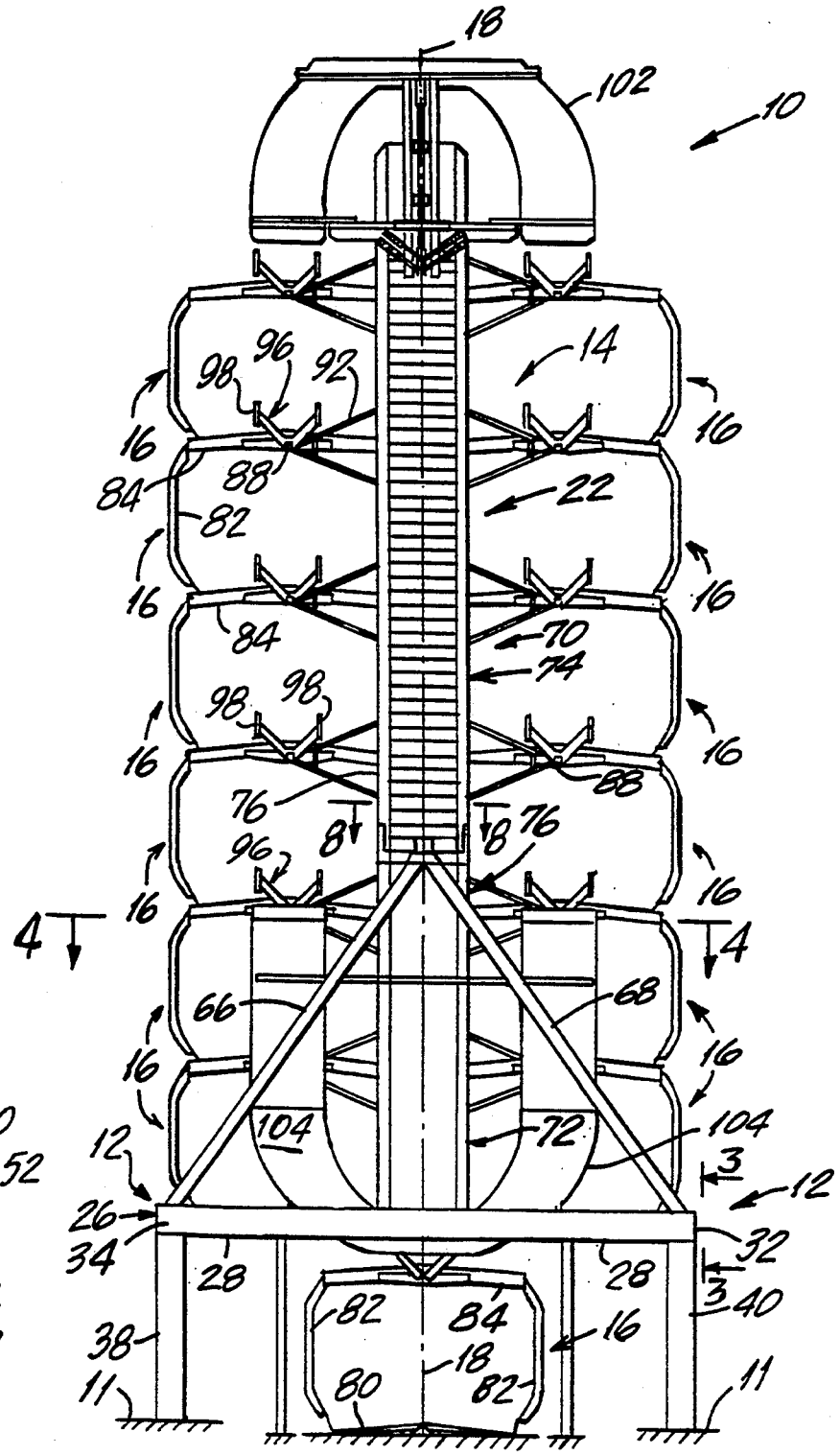
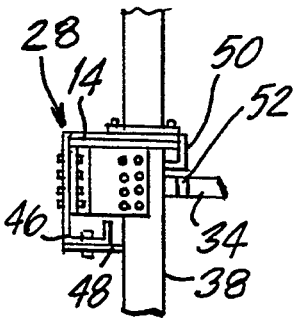
FIG.3
FIG.1

VERTICAL STORAGE CONVEYOR WITH SYMMETRICAL MOTOR DRIVE SYSTEM

FIELD OF THE INVENTION

The present invention relates in general to a conveyor system, and in particular relates to a new and improved motor and drive system for a vertical storage conveyor.

BACKGROUND OF THE INVENTION

The present invention is an improvement to a vertical storage conveyor type apparatus which has been sold and used for parking or storing a number of different items, such as automobiles and automotive parts. Such apparatuses have been sold more than a year prior to the filing of this application and are generally described in the following U.S. patents by the same inventor as herein: U.S. Pat. Nos. 3,424,321; 3,547,281; and 3,656,608, the entire disclosure of each of which is incorporated herein by reference. While there are many features of the present invention in common with this prior art, which such features are described in the aforementioned patents and some of which will be noted hereinbelow in this specification, differences between the present invention and the prior art exist in the power and drive mechanisms.

These prior art vertical conveyors employ two independent vertical frames that are supportingly connected together by beams and struts. Each vertical frame contains an independent conveyor assembly, substantially depicted in the aforementioned U.S. Pat. No. 3,547,281, and which separately convey one end of a load carrying pan. Each conveyor assembly is comprised of a plurality of rigid, compression links pivotally connected together with joint pins to form an endless vertical chain. Suspended from the compression links are a number of pans or platforms arranged in two parallel vertical columns. Rollers or wheels are mounted at each end of the link joint pin travel and are constrained to move only within a vertical guide channel.

A power or motor means, comprised of a single motor mounted on one of the vertical frames, utilizes a conventional electrically driven hydraulic pump to operate a primary drive means located on that frame and through a transmission shaft a primary drive means located on the other frame. Each primary drive means, which is substantially similar to that disclosed in U.S. Pat. No. 3,547,281, includes a number of reduction gear chains reversibly driven by the motor means, which in turn reversibly rotate a lower drive sprocket. The lower drive sprocket in turn drives a gear chain mounted on that sprocket and an upper idler sprocket. Attached to the gear chain are a plurality of fish-shaped pickup members journalled in a spaced apart generally upright, but slightly pivotal relationship. The pickup members engage a compression link joint pin such that when the gear chain is rotated by the motor means, the rotating pickup members, guided by a stationary cam surface, sequentially engage the joint pins to lift that side of the compression links. A tension idler gear removes the slack in the non-driven side of the gear chain.

Although a vertical conveyor according to the aforedescribed prior art functions satisfactorily, it still has a number of drawbacks. For example, the prior art vertical conveyor utilizes an electrohydraulic drive means that includes an electrical motor driving a hydraulic pump which in turn drives a hydraulic motor. While hydraulic drives tend to be reliable, they still require a lot more maintenance, they are relatively noisy and uneven in operation, and they are messier. They also must be kept clean and free of foreign matter which could greatly interfere with a hydraulic motor's operation. In addition, the size of a hydraulic motor and its need for oil sumps, filters, etc. make them heavier, overall more expensive and demanding on the layout and structural design of the supporting frame. Furthermore, it is desirable to have a conveyor system that can be easily assembled and disassembled and moved. A hydraulic drive system is not that easy to install or to remove and move.

Thus, it would be advantageous to be able to utilize other types of power systems, such as one that only uses an electrical motor.

In a vertical conveyor of the type described, the basic loading parameters and the structure of conveyor frame are highly interrelated. One of the principal advantages of this type of vertical conveyor which permits a greater loading, yet still permits the frame weight to be minimized, is the location of the motor means and the conveyor drive means. They are located in the lower vertical half of the device, contrary to a device manufactured by numerous Japanese companies in which they are located near the top of the conveyor. A lower placement greatly reduces the overall conveyor weight, reduces the strength requirements, and provides easier maintenance.

It is also desirable to keep the overall footprint of the conveyor as small as possible. In the prior art device, the footprint is only the area of two automobile parking spaces. However, this devise could only carry twenty-two automobiles. If it is desired to maintain this two-car footprint, yet also to increase the number of automobiles that can be held to, for example, thirty-two or even fifty, the weight distribution and frame structure and size must be carefully designed. Also, the power of the motor means must be considered in order to accommodate the increased number of automobiles. In addition, generally speaking, the more powerful the motor for driving the conveyor, the larger are its physical dimensions. All of the foregoing must be considered in designing a simpler, lighter, and more economical motor and drive system.

SUMMARY OF THE INVENTION

It is therefore an object of the present invention to provide a motor and drive system for a vertical conveyor having the capability of storing and conveying a number of heavy objects such as automobiles. When used in a vertical conveyor for automobiles, such a drive system must be powerful enough to reversibly drive an endless vertical conveyor that is capable of holding a large number of automobiles. Stated another way, it is an object of the present invention to drive a vertical conveyor capable of carrying and conveying about 32 full size U.S. manufactured automobiles having a design weight of 4,200 pounds per vehicle or over 50 small foreign manufactured automobiles having a design weight of under 2,800 pounds.

An embodiment of the present invention has the capability of driving a completely unbalanced load of 4200 pounds per automobile where one side of the conveyor is loaded and the other side is unloaded.

It is also an important feature of the present invention that the speed of the drive be such that a linear travel of 40 feet per minute can be achieved. At this speed for a conveyor holding 14 cars the travel time from the top of the conveyor to the bottom will be less than one minute.

Another objective of the present invention is to retain the advantages of the prior art devices and to have a vertical conveyor that is still easy to assemble and disassemble in situs, but also has a footprint of only two cars. It has been found that one way to minimize the overall width of the vertical conveyor is to locate the motor means in the horizontal space, sometimes called the support spacing, between the two columns of platforms. Thus, in a sense, the spacing between the two columns of platforms determines the maximum width of the drive motor, and further determines the maximum overall power of the motor.

Another feature of the present invention is to have a drive design such that an electrical motor can be used. This requires that the transverse dimensions of the electrical motor and the motor drive system are small enough so that they can be conveniently mounted in the spacing between the two columns of platforms.

In an endless vertical conveyor that has a plurality of cells for holding objects to be conveyed, a complete drive system according to the present invention can be located symmetrically on the transverse centerline in the space between two conveyor load supports or platforms as they pass each other while one is being conveyed upwardly and the other is being conveyed downwardly.

An embodiment of a vertical conveyor according to the present invention is comprised of a frame having two parallel, spaced apart vertical frame members, a beam connected to the frame members, a endless vertical conveyor means mounted on each frame member, a plurality of platforms located between said frame members and mounted at each end to the corresponding conveyor means, and a single motor means mounted to said beam for synchronously driving each conveyor means such that the platforms are conveyed vertically about a racetrack shaped path. In a particular embodiment, the motor means comprises an electrical, double ended drive motor and first and second drive trains respectively driven by the first and second end of the motor. The other end of the drive means is connected to drive the conveyor means. The drive trains are each comprised of a drive shaft, reduction gearing, and a mechanical brake.

Other advantages, features and objects of the present invention will be set forth in or apparent from the detailed description of the preferred embodiment set forth hereinbelow.

BRIEF DESCRIPTION OF THE DRAWINGS

FIG. 1 is an front end elevational, engineering scale view of a vertical conveyor according to a presently preferred embodiment with portions removed so as to depict the features of the present invention, the rear elevational view being substantially similar;

FIG. 2 is a right side elevational, engineering scale view, with portions removed, of the vertical conveyor depicted in FIG. 1, the left side elevational view being substantially similar;

FIG. 3 is an enlarged, end elevational, engineering scale view, with covers removed to show the header girder, taken along line 3—3 of FIG. 1;

DETAILED DESCRIPTION OF THE PREFERRED EMBODIMENT

Figure 2:
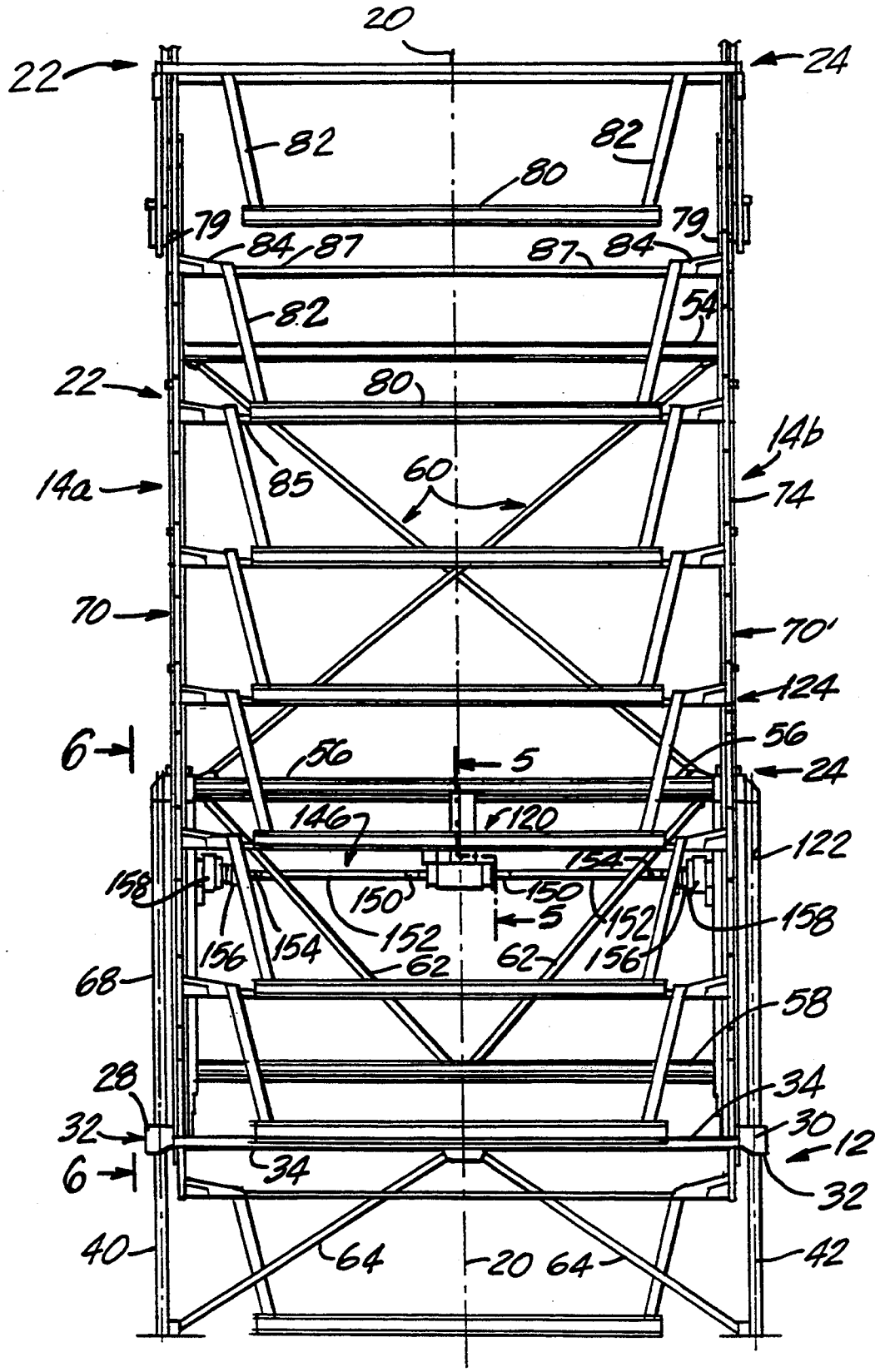

With reference now to the figures, wherein like elements have the same designation throughout the several views, and in particular with reference to FIGS. 1 and 2, a vertical conveyor 10 according to a presently preferred embodiment is depicted as being supported on a concrete foundation 11. Conveyor 10 is comprised of a skeletal frame 12; a compression chain vertical conveyor system 14, which as depicted in FIG. 2, comprises a left subsystem **14*a* and a substantially identical right subsystem 14*b*; and a plurality of platform cells or pans 16 that are hung from conveyor system 14** and are rotated in either direction in a racetrack path thereby.

Conveyor 10 as depicted can convey fourteen cells 16. Each cell has been designed to carry a static load of up to 5,500 pounds, and thus can carry a full size U.S. manufactured automobile. As such, conveyor 10 in a presently preferred version has an overall height of about 51 feet, 8 inches, an overall width of about 20 feet, and an overall length of about 25 feet. However, with relatively easy to make design changes, conveyor 10 can be heightened to convey more than 50 cells 16. The vertical height of conveyor 10 in between these parameters is determined by the permitted overall height of the location where it is to be installed.

Frame 12, as depicted in FIG. 1, is substantially transversely symmetrical about a center line 18, and as depicted in FIG. 2, is substantially longitudinally symmetrical about a center line 20. As depicted in FIG. 2, frame 12 includes a front vertical frame section 22 (also shown in side elevation in FIG. 1) and a substantially identical rear vertical frame section 24 mounted on a rectangular base section 26.

Base section 26 is comprised of two transverse headers, a front transverse header 28 and a rear transverse header 30 (FIG. 2), connected at respective, substantially similar top cornices 32 (see also FIG. 3) to two longitudinal side headers 34 and 36. Headers 28, 30, 34 and 36 together define an annular rectangle in plan view. Base section 26 also includes four legs located at and connected to each cornice 32, only left front leg 38, right front leg 40, and right rear leg 42 being shown.

As shown in FIG. 3, front header 28 has a rotated "G" shape in cross-section or end elevational view. Header 28 has a cross sectional shape with an equal top 44 and side 46 (suggested dimensions are 13 inches) and a small hooked bottom 48 and other side 50 (suggested dimensions are a 4 inch side or bottom) and an attached hooked portion 52 (having suggested dimensions of 1½ inch). Header 28 sits above the automobile entrance to the vertical conveyor and its cross-sectional shape provides numerous advantages. These essentially include a stronger member that is significantly lighter; a member that can be easily installed and taken down because of the shape; and a member that can be economically manufactured because it is essentially bent plate metal. In addition, other conveyor equipment can be mounted inside the G-shaped frame of header 28, such equipment including operating equipment for a gate (not shown) used to block the entrance to conveyor 10.

As depicted in FIG. 2 for the right side of vertical conveyor 10, the left side being substantially the same, a plurality of internal braces on each side of vertical conveyor 10 connect frame sections 22 and 24 together, provide structural rigidity, and equalize the loading between the frame sections. The horizontal internal braces include a top bracing member 53, an upper tubular strut 54, a middle tubular strut 56 and a lower tubular strut 58, each of which is rigidly mounted at its respected ends to frame sections 22 and 24. An "X" cross bracing 60 extends between upper and middle struts 54 and 56, a "V" bracing 62 extends between middle and lower struts 56 and 58, and an inverted "V" bracing extends between side header 36 and the base of legs 40 and 42.

As depicted in FIG. 1 for the front of vertical conveyor 10, the rear of vertical conveyor 10 being substantially the same, frame section 22 is substantially in the form of an A-frame. Frame section 22 has a base formed by header 28 and legs 38 and 40, and has an upper section formed by diagonal columns 66 and 68. Diagonal columns 66 and 68 are bolted at their lower ends to respective cornices 26 of the A-frame base, and are bolted at their upper ends to each other and to a transverse midpoint of a front column 70. A substantially similar rear column is provided for frame section 24 (70′ as depicted in FIG. 2). Column 70 is comprised of a lower section 72 and an upper section 74 that are spliced together with bolts at a vertical mid portion joint 76 (see also FIG. 6). The height of mid portion joint 76 above foundation 11 depends upon the total number of conveyor pans and the overall height of conveyor 10. Lower column section 72 is comprised of essentially a solid one piece weldment, described in greater detail hereinbelow. Upper column section 74 is substantially similar to an earlier commercial embodiment of the parking towers depicted in the aforementioned Lichti U.S. Pat. Nos. 3,656,608 and 3,656,608.

Columns 70 and 70′ also serve a second function of providing a conveyor housing for a rolling compression chain 78, described in greater detail hereinbelow and in the aforementioned Lichti patents. For the purposes of the description of the present invention, the detailed construction of columns 70 and 70′ need not be described in detail and sufficient understanding for the purposes of the present invention can be achieved by referring to aforementioned Lichti U.S. patents for the disclosure of a similar construction. However, it is noted that columns 70 and 72 are of such construction that each one additionally serves as part of a main frame extending upwardly from the front header 28 (or the rear header for rear frame section 24) through a point adjacent the top of conveyor 10 where it supports the upper end of an endless conveyor compression chain 78 (FIG. 2) located therein at the point where chain 78 crosses over from one side to the other.

With reference to FIG. 1, a platform cell 16, as shown at the bottom and along the sides of conveyor housing 70, is comprised of a slightly, upwardly curved, bottom pan 80 which is rectangular in plan view. In a presently preferred embodiment, pan 80 has a radius of curvature of ten feet, a width of about six and one-half feet and a length of about seventeen feet. At this curvature and width, the side edge of pan 80 is two and three-quarter inches below the center. This convex shape, depicted in greater detail in FIG. 4*a*, has numerous advantages, such as it permits a smaller platform cell to platform cell height and provides a stronger pan which can be made from lighter materials.

Mounted to each side of pan 80 are side rails 81 which extend about six inches above the side edge of pan 80. A catch 82 is mounted to the underside of pan 80 along the centerline at each end thereof. Catch 82 has a central slot that is about two inches wide and sloping edges that extend about eight inches from the centerline of pan 80. Catch 82 receive supporting members of a lower cell 16 (described hereinbelow).

Pan 80 is supported at each corner by a vertical pan hanger or post 83. Those posts 83 located on the same side of pan 80 are connected at the tops thereof to an essentially horizontal, V-shaped top pan header 84 (see also FIG. 4). A horizontal, tubular top strut 85 connects the apices of each header 84 and together with two braces 86 are welded thereto. Mounted on the top of strut 85, as shown in FIG. 4, are two engagement rollers 87 which, during operation of conveyor 10, engage the bottom central notch of the cell pan 80 located above it.

Figure 6:
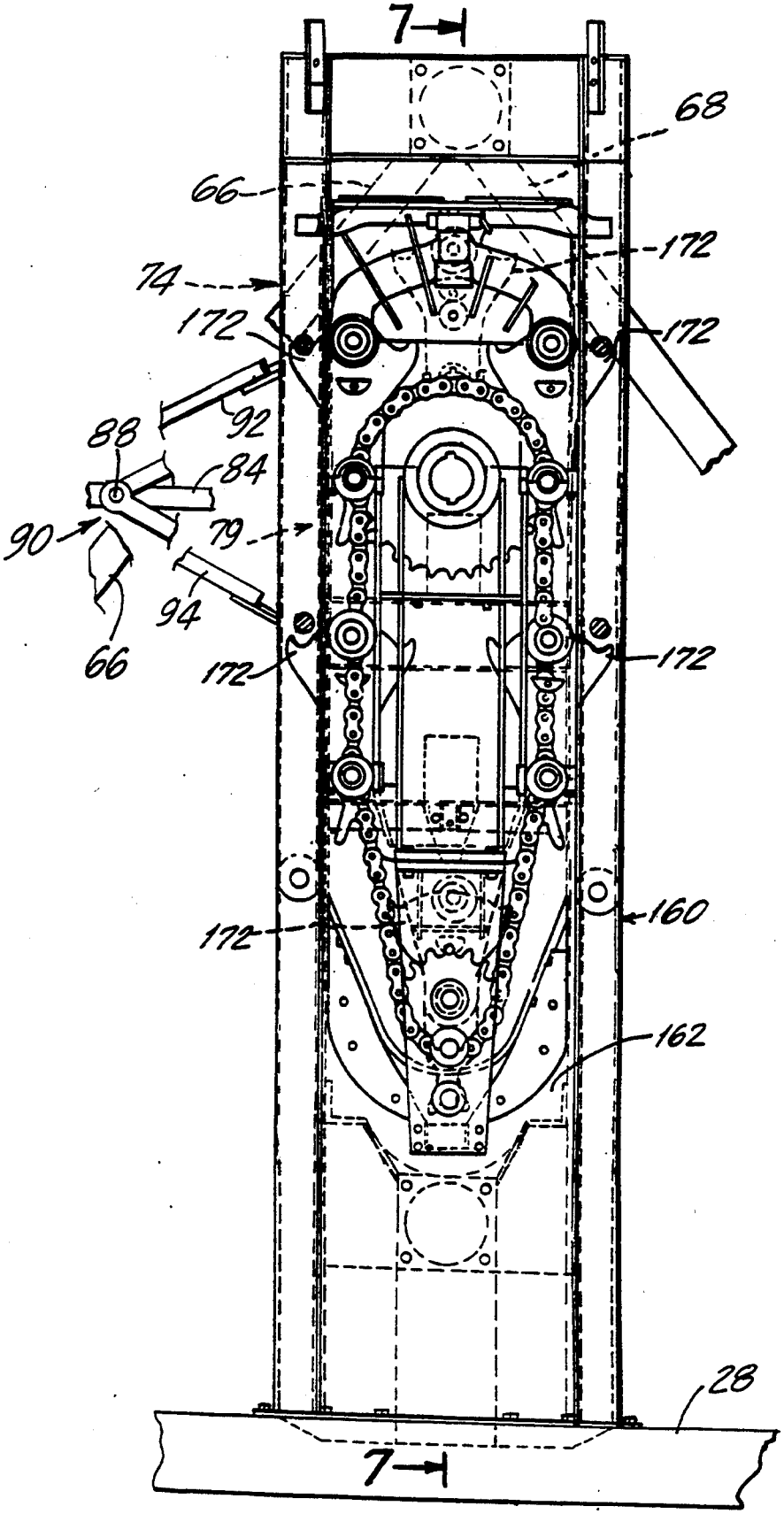
FIG. 6 is an enlarged, engineering scale front elevational view, with parts removed, taken along lines 6—6 of FIG. 2 depicting the drive mechanism for the vertical conveyor.

Platform cell 16 is both mounted and stabilized during its travel around conveyor 10 through a stub shaft 88. Stub shaft 88 extends outwardly from the other side of the apex of each header 84 and is welded thereto. Mounted on stub shaft 88 is a bearing housing 89 which in turn pivotally mounts the apex of a "V" shaped link hanger 90. Link hanger 90 is comprised of two arms 92 and 94 which extend therefrom. As depicted in FIG. 6, arms 92 and 94 of each hanger 90 are pivotally mounted at their respective free ends to a compression link of endless compression chain 78. Thus, a cell 16 is mounted at each end to the corresponding conveyor subsystem 14*a* or 14*b* by link hanger 90.

Figure 4B:
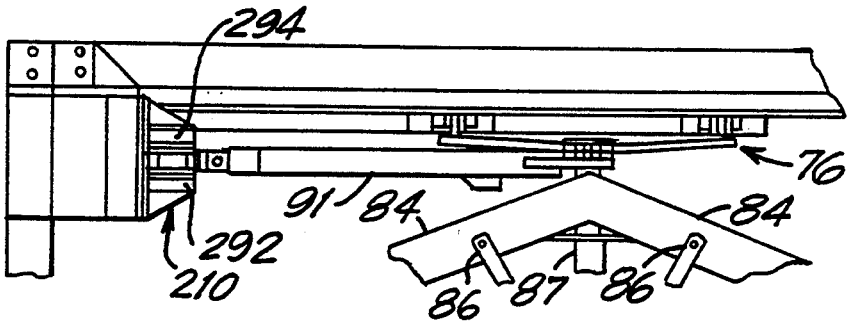
FIG. 4B is an enlarged engineering scale plan view of the pan header and related parts.
Figure 4:
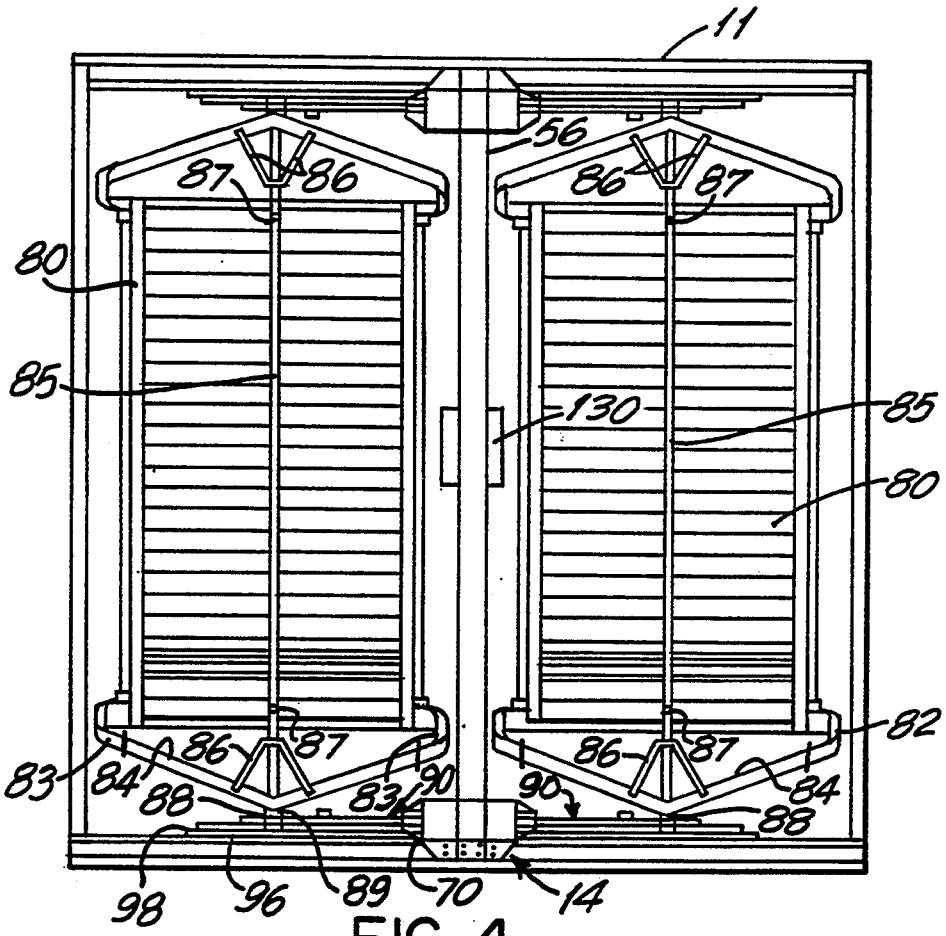
FIG. 4 is an engineering scale plan view, with parts removed, taken essentially in cross-section along line 4—4 of FIG. 1.
Figure 4A:
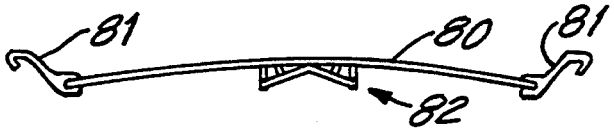
FIG. 4A is an end elevational view, with parts removed, of a pan which holds an automobile.

As shown in FIGS. 1 and 4, also mounted to stub shaft 88, with bolts (not shown), is the apex of a "V" shaped stabilizer 96. Stabilizer 96 in turn, pivotally mounts guide shoes 98. Stabilizer 96 stabilize cell 16 as it is conveyed around the and bottom of conveyor 14. Guide shoes 98 are received in crossing channels (not shown, but like those depicted in U.S. Pat. No. 3,656,608) of a top guide 102 and a bottom guide 104, mounted at each end of front and rear conveyor housings 70 and 72.

In general, the drive mechanism for powering vertical conveyor 10, is somewhat similar to that described in U.S. Pat. No. 3,547,281 and embodied in four different commercial embodiments of the conveyor sold more than a year before the filing of this application. As shown in FIG. 2 in a general way, this mechanism comprises electric motor means 120 (which in the prior embodiments was a hydraulic drive), a primary drive chain assembly 122 rotated by the motor means (which in the prior embodiments included complex, large reduction gears and chains), and a secondary drive chain assembly 124, which includes compression chain 78 that carries cells 16 (which in the prior embodiments is similar to the compression chain depicted in FIG. 3 of U.S. Pat. No. 3,547,281). The improved mechanism is described below.

With reference to FIG. 2, a new and improved motor means 120 for driving vertical conveyor 10 is depicted. The motor means comprises a double ended, reversible, three phase 460 AC volt input, 500 volt DC output, regenerative electrical motor 120 and is connected to and drives a drive assembly 132. Motor 120 preferably has 20 HP and rotates at 1300 RPM with a maximum input current of 54 AC amps and a DC field current of 10 amps at 300 volts. Motor 120 must be overall compact in size so that it can fit between the edges of adjacent bottom pans 80, the maximum width of this spacing being slightly less than the width of conveyor housing 70 (see FIG. 4). The power of motor 120 depends upon the design weight of the conveyed articles, but for a 14 pan tower, a motor is satisfactory if it can provide an output torque of 185 foot-pounds at an RPM of 1300. A motor meeting these requirements was obtained on a special order from the Reliance Electric Company.

Motor 120 is preferably a DC electrical motor because DC motors are smaller in physical size. However, an AC motor, as well as a hydraulic motor, are also usable so long as they are reversible, can produce the requisite torque and can physically fit in the space between passing platform cells 16.

Figure 5:
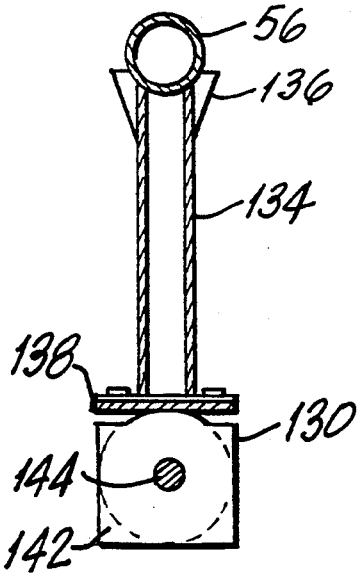
FIG. 5 is a cross-sectional, engineering scale view, partially in schematic, taken along line 5—5 of FIG. 2 and depicting the motor mounting.

As also depicted in FIG. 5, motor 120 is mounted on longitudinal centerline 20 of conveyor 10 by being suspended with a rectangular mounting tube 134 from horizontally extending middle strut 56. The mounting symmetry for motor 120 is important so that maximum efficiency with minimum size and weight of components can be achieved. It is preferred to hang motor 120 from a horizontal cross beam because of structural simplicity and the ease at which structural symmetry can be obtained. However, because the torque of motor 120 is so low, motor 120 could also be mounted differently, such as between two cross braces if those braces were comprised of two spaced apart beams so as to permit the passage of drive assembly 132.

Mounting tube 134 is welded at the upper end to middle strut 56 and has mounting gussets 136 welded between them for increased support. A mounting plate 138, located at the lower end of mounting tube 134, is welded thereto and provides a means onto which a mounting plate of motor 120 can be bolted.

Motor 120 has a forward end 140 and a rearward end 142 and drives a shaft 144 which extends from both ends 140 and 142. Motor drive assembly 132 comprises a forward drive subassembly 146 attached to shaft 144 at motor end 140 and a rearward drive subassembly 148 attached to shaft 144 at motor end 142. Forward and rearward drive subassemblies 146 and 148 are substantially identical and thus identical numerals will be used to describe their components.

Each drive subassembly comprises a commercially available universal joint 150 which connects a drive shaft 152 to motor shaft 144. A second, distal universal joint 154 is connected to the distal end of drive shaft 152.

In order to minimize wear on the motor bearings, drive shaft 152 is mounted at a small downward angle that is preferably 1½ degrees, but which practically could be anywhere from about 1 degree to about 15 degrees, depending upon the mounting requirements for the other components of drive assembly 132 and conveyor system 14. Alternatively, drive shaft 152 could be mounted at a small upward angle with the range of from 1 degree to about 15 degrees.

In yet a further modification, the vertical angle of drive shaft 152 could be zero, that is drive shaft 152 extends horizontally, but is at a horizontal angle with motor shaft 144. In this embodiment, motor shaft 144 is horizontal, but extends at an angle to an axis extending between frame sections 22 and 24. Thus, as would be seen in a top plan view, the two drive shafts would still be parallel, but they would no longer be collinear. Such an arrangement has the advantage that frame sections 22 and 24 could be staggered so as to permit an entrance to platform cell 16 from the side. Obviously, such an arrangement has a potential disadvantage of increasing the support spacing between passing platform cells 16.

Connected to the other end of distal universal 154, through a keyed fitting is a conventional, electrically operated friction brake 156, which in turn is mounted with a spline fitting to a speed reduction gearing 158. The location of brake 156 between drive shaft 152 and reduction gearing 158 is preferred because a smaller brake can be used due to less torque at a higher speed at this location. Brake 156 is used to stop the rotation of conveyor 10, and is a conventional, commercially available friction brake that is kept disengaged by a three amp current loop. This is a fail safe arrangement and the current loop includes both brakes 156 on forward and rearward drive subassemblies 146 and 148. However, brake 156 must have physical dimensions which will permit it to be mounted in the spacing between passing platforms cells 16.

Reduction gearing 158 is a commercially available four stage planetary reduction gear that reduces the speed of revolution of motor 120 from 1300 RPM to about 7 RPM. This provides a reduction ratio of about 185 to 1, however if a slower motor can be used, a reduction ratio as low as 100 to 1 can be utilized. On the other hand, to develop greater torque delivered by reduction gearing 158, in a model designed to hold 32 cars a higher speed motor is used and a reduction ratio of about 300 to 1 is being used. The housing of reduction gearing 158 is mounted at the other end to the corresponding vertical frame section 22 or 24. It has been found that reduction gearing 156 is the limiting component with respect to transverse size so that it can fit into the space between passing conveyor cell pans 80.

The primary drive chain assembly 122 will now be described. Motor drive subassemblies drive respective, substantially similar, primary drive chain assemblies 122. With reference now to FIGS. 1, 2, 6 and 7, each primary drive chain assembly 122 is mounted on a solid, one piece weldment 160, which comprises lower frame section 72 of frame section 22. More particularly, primary drive chain assembly 122 is mounted inside an interior cavity 162 in weldment 160.

Drive chain assembly 164 includes an upper toothed drive sprocket subassembly 166, a lower toothed idler sprocket subassembly 168, a dual drive chain subassembly 170 and five pick-ups 172.

Upper toothed drive sprocket subassembly 166 includes an inside drive sprocket 176, a substantially similar outside drive sprocket 178, and a shaft 180 interconnecting and mounting sprockets 176 and 178. Shaft 180 terminates on its inner end in a spline 182. Spline 182 is mounted to and driven by reduction gearing 158. Each drive sprocket 176 and 178 has a diameter of about 23 inches and a total of 30 teeth.

Lower toothed idler sprocket subassembly 168 includes an inside idler sprocket 184, a substantially similar outside idler sprocket 186, and a shaft 188 interconnecting idler sprockets 184 and 186. Each idler sprocket 184 and 186 has a diameter of about 12¼ inches and a total of 15 teeth.

Drive chain subassembly 170 is comprised of a first roller chain 190 and a second roller chain 192 with matched strands. The centerlines of chains 190 and 192 are spaced apart about 7 inches and the chains are interconnected with five pins 194, a pickup 172 being mounted on each pin 194. Each chain 190 and 192 is thus comprised of five strands, each strand being about 34¼ inches long and terminating in master link (not shown) which connects to the adjacent strand and which mounts a pin 194.

The pickups 172 are substantially similar to those described in U.S. Pat. No. 3,547,281 (referred to in that patent as prop members 112), except that the present pickup has a split body. Each pickup 172 includes an upper head portion 196 and a smaller, lower tail portion 198 that is mounted to upper head portion with bolts and nuts (not shown). Pickup 172 is journalled onto chain pin 194 and is held centered thereon with snap rings on either side (not shown). A notch 200 on each side of the centerline of pickup 172 in the upper head portion 196 engages with and picks up a connecting pin assembly, shown at 210 in FIGS. 6 and 10, in compression chain 78 (see also U.S. Pat. No. 3,547,281).

Secondary drive chain assembly 124 is comprised of rolling compression chain 78 and guide and channel subassemblies. Functionally, secondary drive chain assembly 124 is similar to that described in U.S. Pat. Nos. 3,547,281 and 3,656,608, and in construction is similar to that sold in commercial embodiments in other designs of the parking tower.

Figure 11:
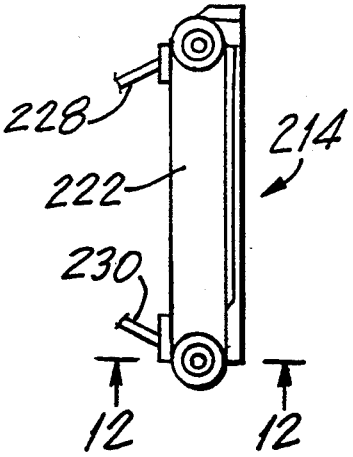
FIG. 11 is a perspective view of a compression chain link showing the rollers mounted thereto.
Figure 10:
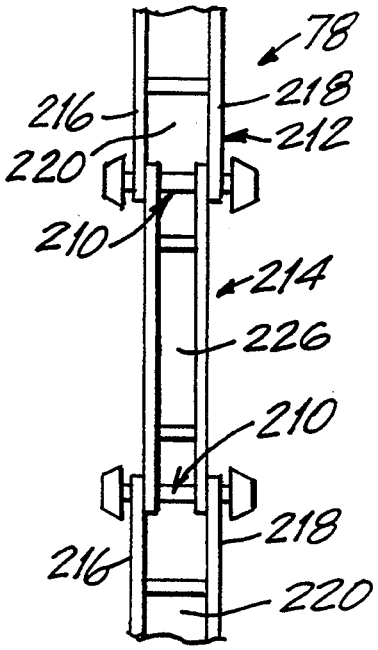
FIG. 10 is a side elevational view of a compression chain.

As shown in FIG. 10, rolling compression chain 78 is comprised of a plurality of outer compression links 212 and inner compression links 214 pivotally interconnected by connecting pin assemblies 210. Outer compression links 212 are comprised of two side plates 216 and 218 and an intermediate, U-shaped web 220 that is welded to each side plate. Similarly, inner compression links 214 are comprised of two side plates 222 and 224 and a connecting intermediate, U-shaped web 226 that is welded to each side plate. Also mounted to inner link 214 are two angled connecting lugs 228 and 230 for respectively connecting to link hanger arms 91 and 92 of cell 16. (FIG. 11)

Figure 12:
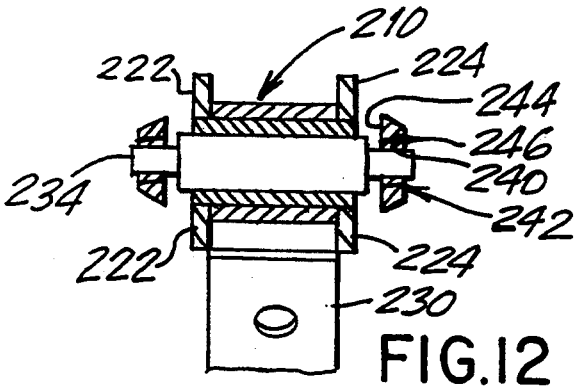
FIG. 12 is a cross-sectional view taken along line 10—10 of FIG. 9, but rotated clockwise ninety degrees.

Connecting pin assembly 210, as shown in FIG. 12, is comprised of a sleeve 232 extending through aligned orifices in side plates 222 and 224 and an axle 234 compressed mounted inside sleeve 232. On each end of axle 234 is mounted a wheel assembly 236. Journalled and shrink fitted around sleeve 232, between side plates 222 and 224, is a carburized, quench hardened bearing roller 238. As shown in FIG. 6, bearing roller 238 is engaged in one of the notches 200 of pickups 172 as the engaging pickup 172 lifts or pushes it and the associated compression link, and hence the whole compression chain 78, upwards. Thus the weight of the whole load on the side of conveyor 10 being rotated is realized through bearing roller 238.

Wheel assembly 236 is comprised of a conventional ball bearing 240 mounted on the end of axle 234. Journalled around ball bearing 240 is a bevelled plastic roller 242. Plastic roller 242 has a trapezoidal shape in cross section and in a presently preferred embodiment has an outer diameter of about 4.5 inches, an inner diameter of about 3.9 inches, a height of about 1.75 inches, and a release slope of preferably 2.5 degrees at the outer end.

In one embodiment, roller 242 is made of a solid plastic material, such as a urethane plastic with a 73–75 hardness on the D scale. Such a material is now commercially available from U.S. Royal Company. In another embodiment, as depicted in FIG. 12, plastic roller 242 has an aluminum or steel annular core 244 and a plastic cladding 246 made of the same urethane material and having a preferable thickness of about 0.6 inches at the sides and 3/16 inch at the base. It has been found that plastic wheels can be made hard enough to withstand the impacts and pressures imparted to it from the conveyor load. In other modifications, a plastic cladded roller 242 can have circumferencial grooves of about 1/32 inch. These grooves tend to stabilize the tread.

Figure 8:
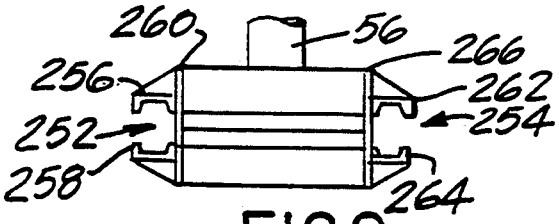
FIG. 8 is a cross-sectional view of the upper column section taken along line 8—8 of FIG. 1.

The guide and channel subassemblies of secondary drive chain assembly 124 do not exist as separate entities, but rather are integral components with other elements of conveyor 10. Thus, for upper frame section 74, as depicted in FIGS. 1 and 8, the outwardmost components are comprised of spaced apart left hand (as seen in FIG. 1) guide rails 252 and right hand guide rails 254. Guide rails 252 are comprised of an inner (as would be seen from FIG. 2) guide channel 256 and an outer guide channel 258 mounted spaced apart to a plate 260 and guide rails 254 are comprised of an inner guide channel 262 and an outer channel 264 mounted spaced apart to a plate 266. Each guide channel also serves as vertical structural component and is a bevelled U-shaped channel that is welded to upper frame section 74. The U-shaped channel has a bevel with a mating size, shape and slope to roller 242. The upper and lower ends of channels 252 and 254 are flared outwardly to permit the compression links 214 to "bend around" the top of frame sections 22 and 24.

Figure 9:
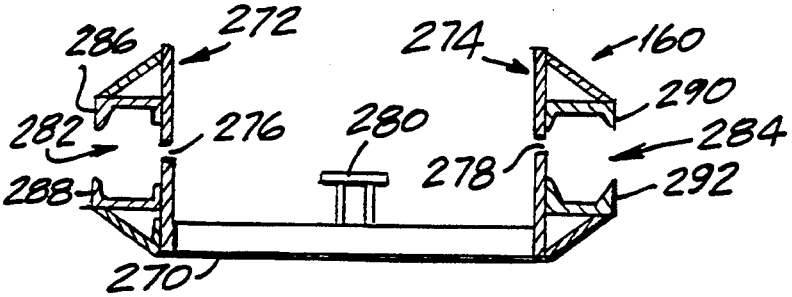
FIG. 9 is a cross-sectional view of the lower column section taken along line 9—9 of FIG. 1.

The guide and channel subassemblies for the lower tower section are parts of weldment 160 and are depicted in 6, 7, 8 and 9. Weldment 160 is comprised of a welded metal sheet base plate 270 having side plates 272 and 274 welded to each end to form a somewhat rectangular box. In the middle section of side plates 272 and 274 are slots 276 and 278 to accommodate pickups 172 entering the channel area and engaging connecting pin 210 of compression chain 78. Weldment 160, as shown in FIG. 9, also contains suitable mounting plates, such as mounting plate 280, for mounting primary dive chain assembly 122.

Mounted to side plate 272 is a guide rails 282 and mounted to side plate 274 is a guide rail 284. Guide rail 282 is comprised of an inner (as would be seen from FIG. 2) guide channel 286 and an outer guide channel 288 mounted spaced apart to side plate 274 and guide rail 284 is comprised of an inner guide channel 290 and an outer channel 290 mounted spaced apart to side plate 274. Each guide channel 286, 288, 290 and 292 also serves as vertical structural component and is a bevelled U-shaped channel that is welded to weldment 160 as explained above. Also each U-shaped channel has the same size and shape as channels 256,258, 262 and 264.

Figure 7:
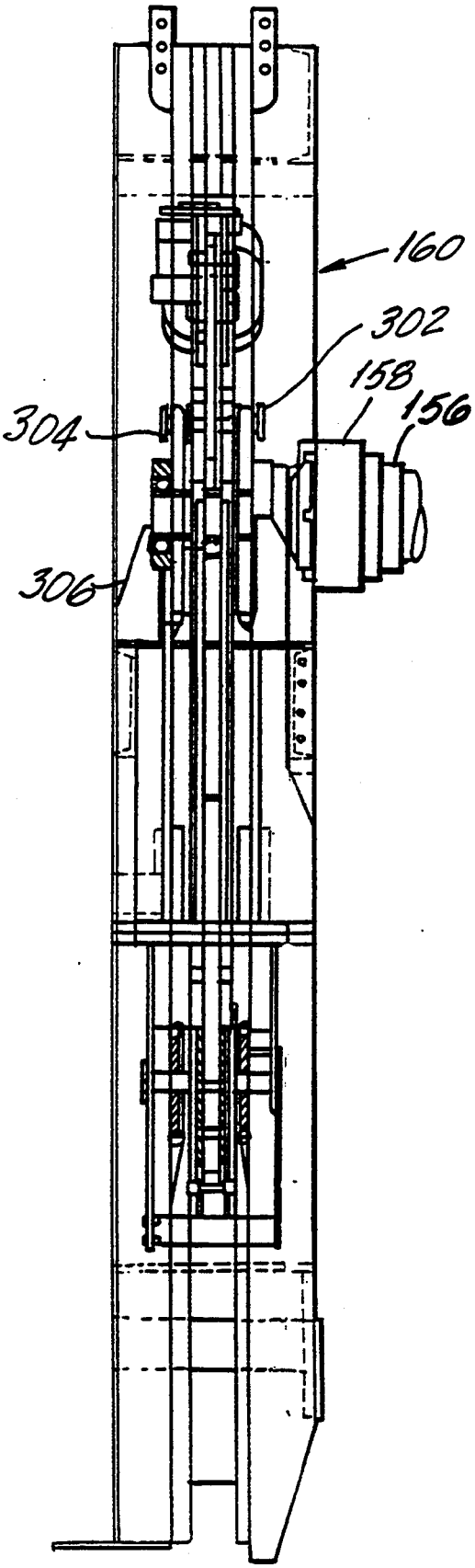
FIG. 7 is a cross-sectional, engineering scale view, with parts removed, taken along line 7—7 of FIG. 6.

Returning now to the mounting of electric motor means 120, reference is made to FIGS. 6 and 7. Reduction gear 158 is bolted with bolts 302 to a mounting plate 304, which in turn is welded to an inner bearing support plate 306. Support plate 306 is part of primary drive chain assembly 122 and is mounted in turn with bolts 308 to a support channel 310 that is part of weldment 160.

The overall operation of vertical conveyor 10 is similar to that described in the aforementioned Lichti patents. For the purposes of the improvements described herein, there are no unobvious differences therefrom.

The present invention has been described with respect to a presently preferred embodiment thereof. Alterations, modifications and other changes would be obvious to those skilled in the art.

I claim:

1. A vertical conveyor comprising a frame having a vertically extending first frame section and a vertically extending second frame section spaced apart from said first frame section;

a plurality of load supports, each support having a first and second end and each support being capable of holding a load to be conveyed around a racetrack type of path and being movably mounted at said first and second ends, respectively, to said first and second frame sections;

wherein there are a plurality of said supports such that as one support is being conveyed upwardly, another support is being conveyed downwardly so that the supports pass one another at a predetermined spaced apart horizontal distance which defines a support spacing;

first conveying means mounted to said first frame section for conveying a first end of said supports;

second conveying means mounted to said second frame section for conveying a second end of said supports;

a mounting member extending in said support spacing; and a motor means for driving said first and second conveying means, said motor means comprising a motor mounted to said mounting member;

a first drive shaft means for connecting said motor to said first conveying means; and a second drive shaft means for connecting said motor to said second conveying means and wherein said mounting member mounts said motor substantially centrally between said frame sections, and wherein said motor means is a double ended electrical motor having first and second motor shaft ends located at respective sides of said motor and respectively connected to said first and second drive shaft means.

2. A vertical conveyor as claimed in claim 1 wherein said first and second frame sections are supportingly connected to each other with a plurality of connecting members rigidly attached at respective ends thereof to said first and second frame sections, and wherein one of said connecting members extends between said first and second frame sections in said support spacing; and wherein said mounting member is mounted to said one connecting member between said first and second frame sections.

3. A vertical conveyor as claimed in claim 2 wherein said motor mounting member is suspended from said one connecting member substantially centrally between said frame sections.

4. A vertical conveyor as claimed in claim 3 wherein said one connecting members extends at least substantially horizontally between said first and second frame sections; and wherein said one connecting member is located in the lower half of said frame sections.

5. A vertical conveyor as claimed in claim 1 wherein said motor means is an electrical motor having first and second motor shaft ends located at respective sides of said motor and respectively connected to said first and second drive shaft means.

6. A vertical conveyor as claimed in claim 1 wherein each said drive shaft means comprises a drive shaft;

a first universal joint connected between one end of said drive shaft and a corresponding one of said motor shaft ends;

a second universal joint connected between the other end of said drive shaft and a corresponding one of said conveying means;

and wherein said motor is mounted such that each said drive shaft extends therefrom at a predetermined angle.

7. A vertical conveyor as claimed in claim 6 wherein said angle is between one to fifteen degrees with the horizontal.

8. A vertical conveyor as claimed in claim 1 wherein each said drive shaft means comprises a reduction gearing means for reducing the speed of revolution delivered to the corresponding one of said conveying means.

9. A vertical conveyor as claimed in claim 8 wherein each said reduction gearing means is a single, multistage planetary reduction gear that reduces the speed of revolution of said motor delivered to the corresponding said conveying means.

10. A vertical conveyor as claimed in claim 9 wherein each said reduction gear reduces the speed of revolution by about a factor of over 100 to 1.

11. A vertical conveyor as claimed in claim 8 wherein each said drive shaft means further includes a remotely operable brake.

12. A vertical conveyor as claimed in claim 11 wherein said brake is connected between said reduction gearing means and said reduction gear.

13. A vertical conveyor as claimed in claim 1 wherein each said drive shaft means further includes a remotely operable brake.

14. A vertical conveyor as claimed in claim 1 wherein each said drive shaft means comprises a drive shaft;

a first universal joint directly connected between one end of said drive shaft and a corresponding one of said motor shaft ends;

a second universal joint directly connected to the other end of said drive shaft;

wherein said motor is mounted such that each said drive shaft extends therefrom at a predetermined angle;

a remotely operable brake directly connected at one end thereof to said second universal joint; and a reduction gearing means for reducing the speed of revolution delivered to the corresponding one of said conveying means, said reduction gearing means being directly connected at one end thereof to the other end of said brake, and being connected at the other end thereof to said conveying means.

15. A vertical conveyor as claimed in claim 1 wherein each said drive shaft means comprises a drive shaft;

a first universal joint directly connected between one end of said drive shaft and a corresponding one of said motor shaft ends;

a second universal joint directly connected to the other end of said drive shaft;

wherein said motor is mounted such that each said drive shaft extends therefrom at a predetermined angle;

a remotely operable brake directly connected at one end thereof to said second universal joint; and a reduction gearing means for reducing the speed of revolution delivered to the corresponding one of said conveying means, said reduction gearing means being directly connected at one end thereof to the other end of said brake, and being connected at the other end thereof to said conveying means.

16. A vertical conveyor comprising a frame having a vertical first frame section and a vertical second frame section spaced apart from, but supportingly connected to, said first frame section, and at least one supporting connecting member rigidly attached at respective ends thereof to said first and second frame sections;

a plurality of load supports, each support having a first and second end and capable of holding a load to be conveyed around a racetrack type of path, and each support being movable mounted at said first and second ends, respectively, to said first and second frame sections;

first means mounted to said first frame section for conveying a first end of said supports;

second means mounted to said second frame section for conveying a second end of said supports; and a motor and drive means for driving said first and second conveying means, said motor and drive means comprising a motor mounted to said at least one connecting member;

a first drive shaft means for connecting said motor to said first conveying means; and a second drive shaft means for connecting said motor to said second conveying means wherein there are a plurality of said supports on each side of said race track path such that as one support is being conveyed upward, another support is conveyed downwardly and said supports pass one another at a predetermined spaced apart distance;

wherein said one connecting member extends at least substantially horizontally between said first and second frame sections in said support spacing; and wherein said motor is a double ended electrical motor mounted to said one connecting member centrally between said first and second frame sections.

17. A vertical conveyor as claimed in claim 16 wherein each said drive shaft means comprises a drive shaft;

a first universal joint directly connected between one end of said drive shaft and a corresponding one of said motor shaft ends;

a second universal joint directly connected to the other end of said drive shaft;

wherein said motor is mounted such that each said drive shaft extends downwardly therefrom at a predetermined angle;

a remotely operable brake directly connected at one end thereof to said second universal joint; and a reduction gearing means for reducing the speed of revolution delivered to the corresponding one of said conveying means, said reduction gearing means being directly connected at one end thereof to the other end of said brake, and being connected at the other end thereof to said conveying means.

18. A vertical conveyor as claimed in claim 16 wherein said conveyor includes a three point mounting assembly for mounting said motor and drive means, said mounting assembly comprising a mounting member centrally mounted to and depending from said one connecting member in a support spacing defined by the horizontal spacing between a load support being conveyed in one direction and a load support being conveyed in the other direction around said racetrack path, said mounting member mounting a central portion of said drive means;

a first bearing means mounted on said first frame section for rotatably supporting an end of said first drive shaft distal from said motor;

a second bearing means mounted on said second frame section for rotatably supporting an end of said second drive shaft distal from said motor;

first attaching means for connecting said distal end of said drive means to said first bearing means; and second attaching means for connecting said distal end of the drive means to said second bearing means.

19. A vertical conveyor as claimed in claim 16 wherein said load support comprising a bottom pan having a substantially convex shape in cross section and a substantially rectangular shape in plan;

a vertically extending pan hanger rigidly mounted at the bottom thereof to each corner of said bottom pan;

a first top pan header connected at each end portion thereof to the tops of those posts located at a first end of said bottom pan;

a second top pan header connected at each end portion thereof to the tops of those posts located at a second end of said bottom pan;

and a horizontally, longitudinally extending top strut connected to each top pan header.

20. A vertical conveyor as claimed in claim 16 wherein each said frame section includes a base, and an upper frame column coaxially mounted on said base, a plurality of load supports, each support having a first and second end and capable of holding a load to be conveyed around a vertical racetrack type of path in which the load supports pass each other at a predetermined horizontal support spacing, a first conveying means mounted to the upper frame column of the first frame section for conveying a first end of said supports, a second conveying means mounted to the upper frame column of the second frame section for conveying a second end of said supports and a drive means extending between said frame sections for driving said first and second conveying means;

the improvement wherein said frame section base comprises a header bar and a first and second vertical columns supporting respective ends of said header bar, said header bar comprised of an top plate and a front plate having substantially the same widths and connected along the lengths thereof, and a lower bottom plate having a width that is less than half the width of said top plate and connected along the length thereof to the bottom of said front plate.

21. A vertical conveyor as claimed in claim 16 wherein said first and second conveying means are substantially similar and comprise a primary drive chain assembly comprising a drive sprocket, and idler sprocket, a chain mounted thereon, and a plurality of pickups mounted on said chain, said drive sprocket being driven by said motor means;

a secondary drive chain assembly that includes an endless chain comprised of interconnecting, elongate compression links;

said transverse axles mounted at each end of said compression links, one axle joining adjacent compression links, and said pickups engaging at least an axle that is proximate thereto and pushing said axle, and thus said compression link, upwardly as said chain is rotated;

means for pivotally mounting said load support mounting arms to said links;

wheel assemblies mounted at each end of said axle, each said wheel assembly comprised of a bearing, and a plastic roller that has a trapezoidal shape in cross section; and guide rail assembly mounted on said corresponding frame sections so as to provide a racetrack shaped guide for said rollers, said guide rail assembly comprised of two opposed, spaced apart guide channels whose cross sectional shape is each a bevelled U-shaped channel which mates with the shape of said roller.

22. The vertical conveyor as claimed in claim 21 wherein said wheel assembly is comprised of a solid urethane plastic material.

* * * * *